United States Patent [19]

Dawn

[11] Patent Number: 4,886,209

[45] Date of Patent: Dec. 12, 1989

[54] POP-UP SPRINKLER WITH ANTI-CLOGGING VALVE

[75] Inventor: Alan W. Dawn, San Clemente, Calif.

[73] Assignee: James Hardie Irrigation, Inc., Laguna Niguel, Calif.

[21] Appl. No.: 120,409

[22] Filed: Nov. 13, 1987

[51] Int. Cl.[4] ..... B05B 3/16

[52] U.S. Cl. ..... 239/116; 239/205; 239/578; 239/582.1; 137/242; 251/248

[58] Field of Search ..... 239/203–206, 239/578, 581.1, 581.2, 582.1, 596, 533.14, 114, 116; 137/242; 251/248, 301

[56] References Cited

U.S. PATENT DOCUMENTS

| | | | |
|---|---|---|---|
| 2,086,281 | 7/1937 | Nelson et al. | 239/204 X |
| 3,125,296 | 3/1964 | Gold | 239/216 |
| 3,383,047 | 5/1968 | Hauser | 239/206 |
| 3,645,451 | 2/1972 | Hauser | 239/206 |
| 3,785,565 | 1/1974 | Perry | 239/206 |
| 3,940,066 | 2/1976 | Hunter | 239/204 |
| 4,272,024 | 6/1981 | Kah, Jr. | 239/206 |
| 4,729,511 | 3/1988 | Citron | 239/205 |

*Primary Examiner*—Andres Kashnikow

*Attorney, Agent, or Firm*—Gordon L. Peterson; Loyal M. Hanson

[57] ABSTRACT

A sprinkler includes a pop-up stem that defines a passage extending to a downwardly facing opening that is circumscribed by a generally planar surface and covered by a valve element dimensioned and arranged in confronting relationship with the planar surface to at least partially block the opening. The valve element is mounted on the stem to enable movement in a plane generally parallel to the planar surface in order to vary an amount by which the valve element blocks the opening, and rotation of a shaft causes valve element movement to restrict the flow of liquid through the opening a selected amount. A resiliently deformable valve element may be loosely mounted to provide clearance sufficient to enable movement of particulate material from between the valve element and the planar surface while enabling the liquid to urge the valve element toward the planar surface. A splined shaft that engages teeth on the valve element may be resiliently deformable so that it twists slightly when movement of the valve element is impaired in order to urge the valve element slightly away from the planar surface as well as to prevent damage to the teeth.

22 Claims, 2 Drawing Sheets

POP-UP SPRINKLER WITH ANTI-CLOGGING VALVE

CROSS REFERENCE TO RELATED APPLICATION

This application is related to copending and commonly assigned U.S. patent application Ser. No. 057,792, filed June 3, 1987, now U.S. Pat. No. 4,729,511, entitled "Pop-Up Sprinkler."

BACKGROUND OF THE INVENTION

1. Technical Field.

The invention relates generally to irrigation equipment and the like, and more particularly to a sprinkler featuring a new and improved externally adjustable valve.

2. Background Information.

Sprinklers sometimes include a manually operated valve for purposes of adjusting the flow rate. The valve is disposed within the sprinkler housing and operated by manipulation of an adjustment mechanism accessible from the housing exterior. With this arrangement, the valve can be conveniently adjusted after the sprinkler is installed to achieve a desired sprinkling flow rate.

The copending application identified above describes a new and improved pop-up sprinkler having an externally adjustable valve for this purpose. The valve element is driven with an externally-operated splined drive shaft to achieve more convenient, controlled valve adjustment while inhibiting undesired misadjustment. With the drive shaft construction, adjustment does not require manipulation of a wet stem, and the drive shaft and valve may employ gear reduction that makes fine adjustments more convenient and inadvertent misadjustment less likely.

However, there are certain aspects of the novel sprinkler described in that application that could be further improved. Consider certain details of its construction, for example. Generally, it includes a housing defining a hollow interior and an inlet port through which to supply a flow of liquid to the interior. A stem is disposed at least partially within the interior of the housing so that the stem can be moved between a retracted position and an extended position, and a piston disposed within the interior of the housing responds to the flow of liquid to move the stem.

The stem defines a passageway extending from a lower portion of the stem to a sprinkler head on an upper portion. The lower portion defines an opening through which the flow of liquid can pass from the interior of the housing into the passageway for passage to the sprinkler head, and a valve element moveably mounted on the stem at least partially blocks the opening. A shaft rotatably mounted on the housing extends to a position outside of the interior of the housing, and it is coupled to the valve element so that the valve can be rotated by rotation of the shaft for purposes of restricting the flow of liquid through the opening a selected amount.

More specifically, the illustrated valve element takes the form of a collar over a cylindrically-shaped portion of the stem so that the collar can be rotated relative to the stem to various alignments of an orifice in the collar and the opening in the stem. The valve element includes gear teeth which engage splines on the shaft for this purpose, and this provides gear reduction as well as maintaining coupling as the stem moves between the retracted and extended positions.

Although effective, this arrangement can be vulnerable to sand or other particulate material clogging or impairing movement of the valve element. The collar fits concentrically over the cylindrically-shaped portion of the stem, and this fit is somewhat close in order to inhibit water from leaking between the collar and stem. As a result, sand or other particulate material may become lodged between the collar and the stem and interfere with rotation of the valve element. In other words, the particulate material tends to cause the collar to bind or stick so that it may be somewhat difficult to rotate it by operation of the splined shaft.

Consequently, it is desired to have a new and improved pop-up sprinkler that alleviates this concern--one with a valve arrangement that is less vulnerable to becoming clogged by particulate material.

SUMMARY OF THE INVENTION

This invention solves this problem with an improved valve arrangement. Briefly, the above and further objects of the present invention are realized by providing an improved sprinkler apparatus having a stem that defines a downwardly facing opening circumscribed by a generally planar surface. A valve element dimensioned and arranged in confronting relationship with the planar surface to at least partially block the opening is mounted on the stem so that the valve element can be moved in a plane generally parallel to the planar surface. This arrangement retains many advantages of the pop-up sprinkler described in the copending application while reducing the accumulation of particulate material between the valve element and stem.

Generally, a sprinkler apparatus constructed according to the invention includes a housing defining a hollow interior intermediate upper and lower ends of the housing and an inlet port through which to supply a flow of liquid to the interior. A stem is mounted within the interior of the housing for movement under influence of the flow of liquid from a retracted position to an extended position, and the stem defines a passage that extends to a opening through which the flow of liquid can flow from the interior of the housing into the passage.

According to a major aspect of the invention, the opening faces downwardly and is circumscribed by a generally planar surface that functions as a valve seat. In addition, a valve element dimensioned and arranged in confronting relationship with the planar surface to at least partially block the opening is mounted on the stem to enable movement of the valve element in a plane generally parallel to the planar surface in order to vary an amount by which the valve element blocks the opening. Movement is accomplished with components such as a rotatable splined shaft so that the valve element restricts the flow of liquid through the opening a selected amount.

According to another aspect of the invention, there is provided components for mounting the valve element on the stem pivotally so that the valve element can be moved about an axis generally perpendicular to the planar surface. This mounting is somewhat loose so that clearance results between the valve element and the planar surface to enable movement of particulate material from between the valve element and stem. However, the loosely mounted valve element can move toward the planar surface under influence of the flow of liquid for purposes of inhibiting passage of the liquid between the valve element and the planar surface.

According to yet another aspect of the invention, there is provided a resiliently deformable splined shaft that twists slightly when movement of the valve element is impaired, such as when the valve element reaches the limits of movement controlled by stop members on the valve element. This results in at least one of the splines bearing against the valve element so that there is a component of force directed perpendicular to the planar surface that causes the valve element to move slightly away from the planar surface. As a result, the particulate material can be flushed from between the valve element and the planar surface. If the shaft is rotated further, the spline skips over the teeth in a ratchet-like action, rather than breaking the teeth.

The above mentioned and other objects and features of this invention and the manner of attaining them will become apparent, and the invention itself will be best understood, by reference to the following description taken in conjunction with the accompanying illustrative drawings.

DESCRIPTION OF THE PREFERRED EMBODIMENTS

Figure 1:
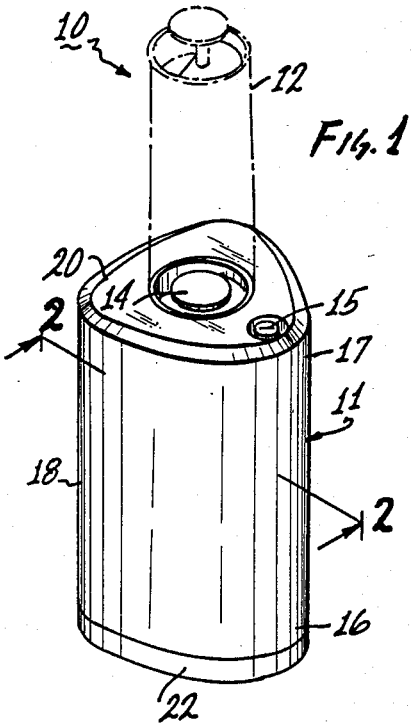
FIG. 1 is a perspective view of a sprinkler apparatus constructed according to the invention showing the stem in a retracted position in solid lines and an extended position in phantom lines.
Figure 4:
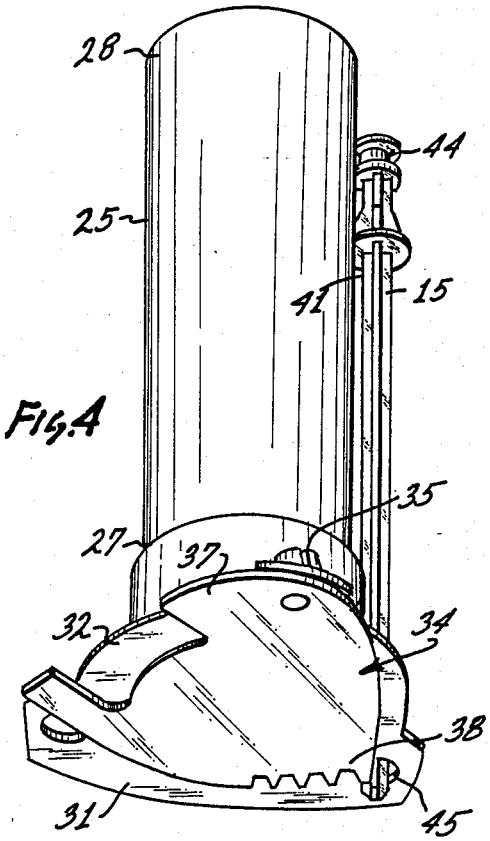
FIG. 4 is an enlarged perspective view of the stem and drive shaft apart from the housing which shows the valve element over the downwardly facing opening.

Referring now to FIG. 1, there is shown a new and improved pop-up sprinkler or apparatus 10 constructed according to the invention. Generally, the apparatus 10 includes a housing 11 on which is mounted a stem 12 that can be moved between a retracted position as shown in solid lines and an extended position as indicated in phantom lines. A flow of liquid, such as water, is supplied to the housing, and the pressure of the flow of liquid causes the stem 12 to move to the extended position, with the liquid discharging from the sprinkler head 14. Rotation of a shaft 15 restricts the flow of liquid through the stem 12, and this enables adjustment of the sprinkling rate and radius of flow at which the liquid is discharged from the sprinkler head 14.

Typically, a lower portion-16 of the housing 11 is buried within the earth so that an upper portion 17 is generally flush with the surface of the earth. The stem 12 assumes the retracted position until the flow of liquid is supplied to the apparatus 10, and then the stem 12 pops up to the extended position to discharge the liquid in a desired sprinkling pattern.

Considering first the housing 11, it includes a shell 18 defining a hollow interior 19 (FIGS. 2 and 3) extending from the bottom portion 16 of the housing 11 to the upper portion 17 of the housing 11. An upper cap 20 attached to the shell 18 by suitable means such as sonic welding or integrally attached in one-piece construction, encloses the interior 19 while defining an opening 21 through which the stem 12 extends. The upper cap 20 also provides a bearing arrangement for the shaft 15 as subsequently discussed.

The housing 11 includes a lower cap 22 attached by suitable means to the case 11 across the bottom portion 16 of the housing 11. The lower cap 22 defines an inlet port 23 through which to pass a flow of water into the interior 19. A connector portion 24 of the lower cap 22 is adapted to receive a threaded line supplying the flow of water (not shown).

Preferably, the housing 11 is composed of a suitable thermoplastic material that provides rigidity and resistance to chemical deterioration when buried in the earth. It is injection molded according to known techniques, and the upper and lower caps are attached so that the housing 11 is generally fluid tight. As an idea of size, the illustrated casing 11 is approximately twelve to thirteen centimeters high between extremes of the upper cap 20 and lower cap 22, and approximately six to seven centimeters across. Of course, these dimensions may vary according to the specific application.

Figure 2:
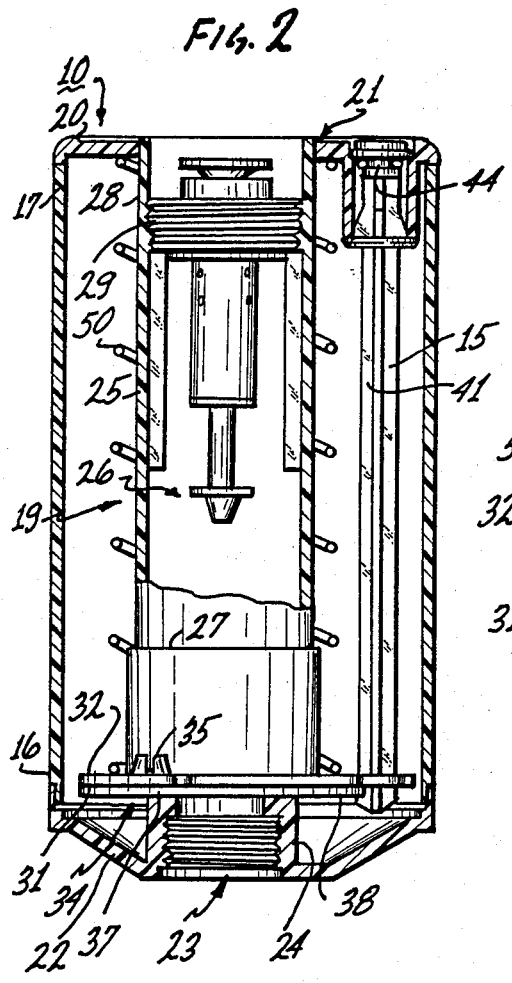
FIG. 2 is an enlarged cross sectional view of the apparatus taken on line 2—2 of FIG. 1 with the stem in the retracted position.
Figure 3:
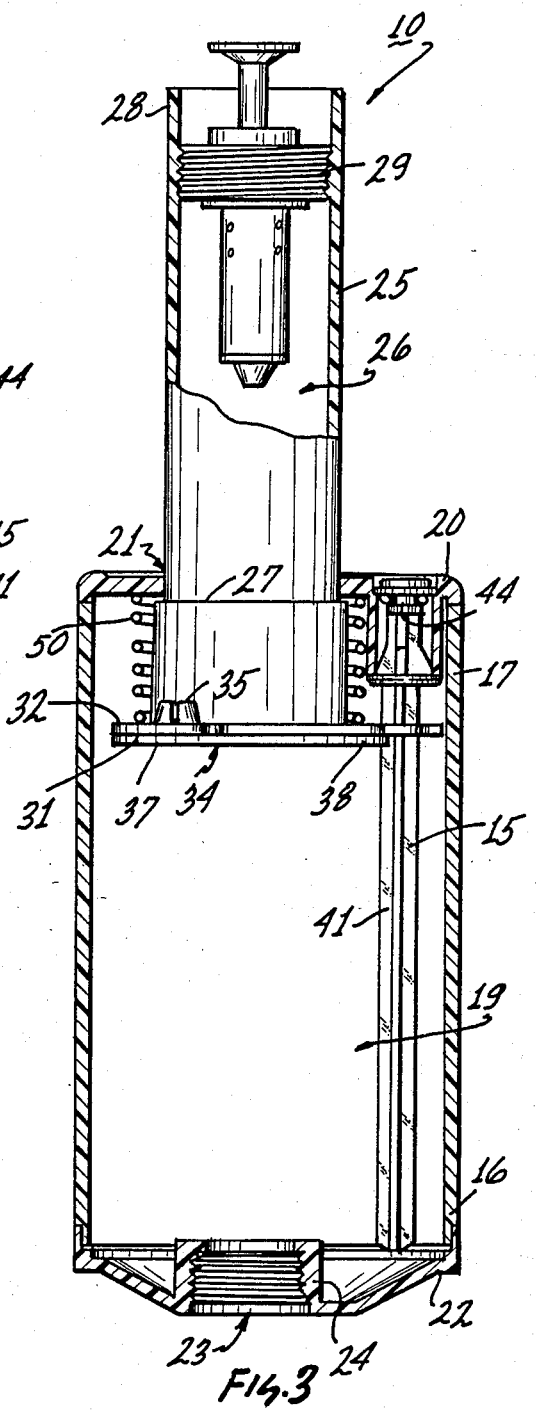
FIG. 3 is an enlarged cross sectional view similar to FIG. 2 with the stem in the extended position.

A flow of liquid is supplied through the inlet port 23 to the interior 19, and it flows through the stem 12 to be discharged from the sprinkler head 14, the stem 12 communicating the flow of liquid from the interior 19 to the sprinkler head 14 (FIGS. 2 and 3). The stem 12 includes a tubular body 25 that defines a passageway 26 extending from a lower portion 27 of the body 25 to an upper portion 28 of the body 25 for this purpose. As a further idea of size, the illustrated stem 12 is approximately three centimeters in outside diameter and approximately ten to eleven centimeters long between the extremities of the lower portion 27 and the upper portion 28.

The sprinkler head 14 is mounted in fluid communication with the passageway 26 at the upper portion 28 of the body 25 by suitable means such as a threaded plug 29 (FIGS. 2 and 3). The lower portion 27 defines at least one opening 30 which, according to a major aspect of the invention, faces downwardly (FIG. 5) The flow of liquid passes from the interior 19 of the housing 11 through the opening 30 to the passageway 26 of the stem 12. Preferably, the opening 30 is an open end of the tubular body 25, although it can be otherwise configured within the inventive concepts disclosed.

In addition, to the downwardly facing opening 30, there is provided a generally planar surface 31 circumscribing the opening 30 that functions as a valve seat. In the apparatus 10, the surface 31 is a face of a piston 32 that is part of the stem 12. The piston 32 responds to the flow of liquid to cause the stem 12 to move from the retracted position to the extended position, and the piston face or surface 31 faces downwardly generally perpendicular to the direction the stem 12 moves. Thus, the flow of water exerts pressure upwardly against it to move the stem 12.

Figure 5:
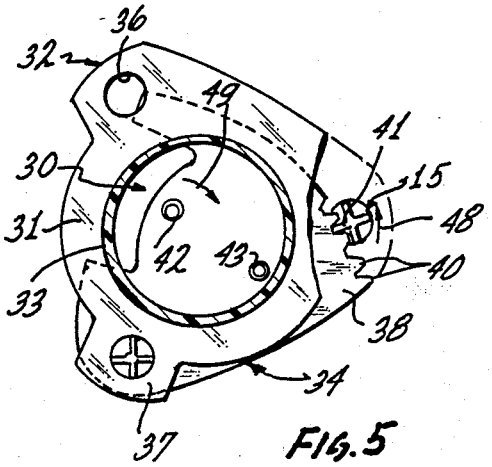
FIG. 5 is a bottom view showing further details of the valve element.

Of course, this can be accomplished with different piston arrangements. In addition, the surface 31 can be defined by other structure, such as a lower end 33 of the tubular body 25 (FIG. 5). However, the illustrated apparatus 10 utilizes a stem-and-piston combination of unitary thermoplastic construction so that the piston 32 is integrally attached in one-piece construction to the lower portion 27 of the stem 12, and so constructed it defines the generally planar surface 31 circumscribing the opening 30.

The opening 30 and surface 31 operate in conjunction with a valve element 34 that is dimensioned and arranged in confronting relationship with the surface 31 to at least partially block the opening 30. For this purpose, the apparatus 10 employs a valve element 34 in the form of a two millimeter thick sheet of thermoplastic material.

The valve element 34 is mounted on the stem 12 to enable movement of the valve element 34 in a plane generally parallel to the surface 31 in order to vary an amount by which the valve element 34 blocks the opening 30. In the illustrated apparatus 10, mounting means for doing this is provided in the form of an upwardly-extending shaft member 35 (FIGS. 2-5) that is integrally attached to the valve element 34. The shaft member 35 may include an enlarged slotted head that conventionally snaps into a hole in the piston 32. The hole is not visible in the drawings, but it is similar to a hole 36 in FIG. 5.

From another perspective, this arrangement serves as means for mounting the valve element on the stem 12 to enable movement of the valve element 34 about an axis that is generally perpendicular to the surface 31 and spaced apart from the opening 30. The shaft member 35 extends from a first marginal edge portion 37 of the valve element 34, and thus the first marginal edge portion 37 is pivotally mounted on the stem 12 to enable pivotal movement about the axis.

The valve element 34 also includes a second marginal edge portion 38 that is disposed toward the shaft 15 (FIGS. 2–5). The second marginal edge portion 38 includes a plurality of teeth 40 (FIG. 5) that are dimensioned and arranged to engage a plurality of splines on the shaft 15, such as the spline 41, for purposes of coupling rotational movement or pivotal movement from the shaft 15 to the valve element 34 in order to cause the valve element 34 to pivot and thereby vary the amount the opening 30 is blocked. This arrangement serves as means for coupling rotational movement from the shaft 15 to the valve element 34, and a pair of stop members 42 and 43 (FIG. 5) that are integrally formed with the valve element 34 abut the tubular body 25 as the valve element 34 is pivoted to serve as means for limiting movement of the valve element 34. Limiting movement retains the teeth in proper alignment with the shaft 15. It also initiates the camming action subsequently described.

Considering again the piston 32, it has a shape which generally conforms to the non-circular cross sectional shape of the interior 19 of the housing 11 in a plane generally perpendicular to the direction the stem 12 is moved by the flow of liquid. This serves to prevent rotation of the piston 32 and the stem 12 relative to the housing 11. Also, the piston 32 includes a shaft hole 45 (FIG. 4) extending through the piston 32 that receives the shaft 39. This retains the shaft 15 in desired proximity with the valve element 34 so that the splines 41 are retained in engagement with the gear teeth 40. As the stem 12 is moved between the retracted position and the extended position, the valve element 34 slides along the shaft 15, with the teeth 40 retained in desired engagement with the splines 41. Of course, other coupling arrangements can be utilized, such as the inclusion of an idler gear between the shaft 15 and the teeth 40 or a gear slidably mounted on the shaft 15 that engages the gear teeth 40.

The shaft 15 includes an upper end portion 44 that is rotatably mounted on the upper cap 20 (FIGS. 2 and 3) to enable rotational movement of the shaft 15 by such means as manual engagement of a slot in a head of the shaft 15. Thus, by the insertion of a suitable tool, such as a screwdriver blade or key, for example, one can rotate the shaft 15 to cause the valve element 34 to rotate or pivot and thereby adjust the amount that the valve element 34 blocks the opening 30. This arrangement provides a degree of security against inadvertent or purposeful misadjustment. In addition, the combination of the shaft 15 and the teeth 40 provides a reduction in rate of rotation that facilitates fine adjustment of the flow of liquid.

According to another aspect of the invention, there is provided means for urging the valve element 34 slightly away from the surface 31 when movement of the valve element 34 is impaired by particulate material between the valve element 34 and the surface 31. This is accomplished in the illustrated apparatus 10 by the shaft 15 being composed of a resiliently deformable material such that the shaft twists slightly when movement of the valve element 34 is impaired.

Figure 6:
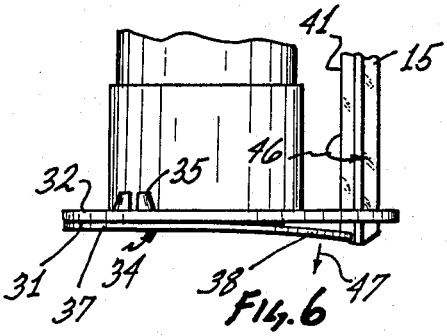
FIG. 6 is an elevational view of a portion of the stem showing the camming action of the splined shaft.

Thus, as the shaft 15 is rotated in the direction of an arrow 46 in FIG. 6, one of the stop members 42 and 43 eventually abuts the tubular body 25. When this occurs, the shaft 15 deforms by twisting or bowing slightly, and the spline 41 deforms slightly also to define a slightly inclined surface that bears against the valve element 34, producing a force component perpendicular to the surface 31. This results in a camming action that urges the valve element 34 slightly away from the surface 31 as depicted by an arrow 47, with the result that particulate material can be flushed away by the flow of liquid. Also, this camming action prevents damage to the teeth 40 if the shaft 15 is forced after one of the stop members 42 and 43 abuts the tubular body 25--the spline 41 skips over the teeth rather than breaking them.

In addition, the valve element 34 is composed of a resiliently deformable material such that the valve element 34 can deform slightly to provide clearance between the valve element 34 and the surface 31. Also, the shaft member 35 on the valve element 34 may be dimensioned to provide a slightly loose fit, and this serves as means for loosely mounting the valve element 34 on the stem 12 so that there is clearance between the valve element 34 and the surface 31 sufficient to enable movement of particulate material from between the valve element 34 and the surface 31. Despite the clearance, the valve element 34 is urged under influence of the flow of liquid to a position closer the surface 31, and this inhibits passage of the flow of liquid between the valve element 34 the surface 31.

In operation, the apparatus 10 is buried as described above and operatively connected to a flow of liquid. The flow of liquid exerts pressure against the valve element 34 and exposed portions of the surface 31, and this causes the stem 12 to pop up to the extended position. Some of the liquid flows through the opening 30, and into the passageway 26 for subsequent discharge from the sprinkler head 14.

In order to adjust the rate of flow, the shaft 15 is rotated manually, such as indicated by an arrow 48 in FIG. 5, and this causes the valve element 34 to pivot relative to the stem as indicated by an arrow 49. As the valve element 34 pivots, the amount that it blocks the opening 30 is adjusted to a desired amount, and this restricts the flow of liquid to a desired rate. When the flow of liquid is turned off, the stem 12 returns to the retracted position under the influence of a spring 50 that supplements the pull of gravity to produce a positive return.

Thus, this invention solves clogging problems with a downwardly facing opening that is circumscribed by a generally planar surface and covered with a pivotable valve element. This arrangement retains many advantages of the pop-up sprinkler described in the copending application while reducing the accumulation of particulate material between the valve element and stem.

Although an exemplary embodiment of the invention has been shown and described, many changes, modifications, and substitutions may be made by one having ordinary skill in the art without necessarily departing from the spirit and scope of this invention.

What is claimed is:

1. A sprinkler apparatus, comprising:

a housing having a hollow interior, upper and lower ends and an inlet port through which to supply a flow of liquid to the interior;

a stem mounted within the interior of the housing to enable movement of the stem upwardly under influence of the flow of liquid from a retracted position to an extended position, the stem defining a passage that extends to a downwardly facing opening through which the flow of liquid can flow from the interior of the housing into the passage;

a surface circumscribing the downwardly facing opening;

a valve element dimensioned and arranged in confronting relationship with the surface to at least partially block the opening;

means for mounting the valve element on the stem to enable pivotal movement of the valve element about an axis of rotation to vary an amount by which the valve element blocks the opening, the axis of rotation of said valve element being radially outside said downwardly facing opening; and means for moving the valve element so that the valve element restricts the flow of liquid through the opening a selected amount.

2. An apparatus as recited in claim 1, wherein said axis is generally perpendicular to the surface.

3. An apparatus as recited in claim 1, wherein the means for mounting includes:

a first marginal edge portion of the valve element that is pivotally mounted on the stem to enable pivotal movement about the axis.

4. An apparatus as recited in claim 1, wherein the means for moving includes:

a shaft rotatably mounted on the housing; and means for coupling rotational movement from the shaft to the valve element.

5. An apparatus as recited in claim 4, wherein:

the shaft has a plurality of splines; and the valve element includes a first marginal edge portion that is pivotally mounted on the stem to enable pivotal movement about the axis, said axis being generally perpendicular to the planar surface, and a second marginal edge disposed toward the shaft, the second marginal edge having a plurality of teeth that are dimensioned and arranged to engage a plurality of splines on the shaft for purposes of coupling rotational movement from the shaft to the valve element to cause the valve element to pivot about the axis.

6. An apparatus as recited in claim 5, further comprising:

means for urging the valve element slightly away from the surface when movement of the valve element is impaired.

7. An apparatus as recited in claim 1, wherein the means for mounting includes:

means for loosely mounting the valve element on the stem so that there is clearance between the valve element and the surface sufficient to enable movement of particulate material from between the valve element and the surface.

8. An apparatus as recited in claim 7, wherein:

the means for loosely mounting is configured to enable the valve element to be urged under influence of the flow of liquid to a position closer the surface, to thereby inhibit passage of the flow of liquid between the valve element and the planar surface.

9. An apparatus as recited in claim 1 wherein the valve element includes:

stop means for limiting movement of the valve element.

10. An improved sprinkler apparatus having:

a housing having a hollow interior and an inlet port through which to supply a flow of liquid to the interior;

a stem mounted on the housing to be moved between a retracted position and an extended position, the stem having a passageway and an opening through which the flow of liquid can pass from the interior of the housing to the passageway within the stem;

a piston mounted within the housing to respond to the flow of liquid and move the stem from the retracted position to the extended position;

a valve element mounted on the stem, which valve element is adapted to be moved relative to the stem to at least partially block the opening;

a shaft rotatably mounted on the housing;

coupling means for coupling the shaft to the valve element so that the valve can be moved by rotation of the shaft for purposes of restricting the flow of liquid through the opening a selected amount;

wherein the improvement comprises:

the stem being configured so that the opening faces downwardly;

the stem having a generally planar surface circumscribing the opening;

the valve element being dimensioned and arranged in confronting relationship with the planar surface to at least partially block the opening; and the valve element being mounted on the stem for pivotal movement about a rotational axis which is radially outside said opening to enable movement of the valve element in a plane generally parallel to the planar surface in order to vary an amount by which the valve element blocks the opening.

11. An apparatus as recited in claim 10 wherein said axis is generally perpendicular to the planar surface.

12. An apparatus as recited in claim 11, wherein the coupling means includes:

means for coupling rotational movement from the shaft to the valve element to cause the valve element to pivot about the axis.

13. An apparatus as recited in claim 12, wherein the shaft includes:

means for urging the valve element slightly away from the planar surface when movement of the valve element is impaired.

14. An apparatus as recited in claim 10, wherein the means for mounting includes:

means for loosely mounting the valve element on the stem so that there is clearance between the valve element and the planar surface sufficient to enable movement of particulate material from between the valve element and the planar surface.

15. A sprinkler apparatus, comprising:

a housing defining a hollow interior intermediate upper and lower ends of the housing and an inlet port through which to supply a flow of liquid to the interior;

an elongated stem mounted within the interior of the housing to enable movement of the stem upwardly under influence of the flow of liquid from a retracted position to an extended position, the stem defining a passage that extends to a downwardly facing opening at a lower end portion of the stem through which the flow of liquid can flow from the interior of the housing into the passage;

a generally planar surface circumscribing the downwardly facing opening;

a valve element dimensioned and arranged in confronting relationship with the planar surface to at least partially block the opening which valve element is pivotally mounted on the stem about a rotational axis which is radially outside the downwardly facing opening to enable movement of the valve element in a plane generally parallel to the planar surface in order to vary an amount by which the valve element blocks the opening and to enable slight movement of the valve element under influence of the flow of liquid toward the planar surface in order to inhibit passage of the flow of liquid between the valve element and the planar surface; and means for moving the valve element in the plane generally parallel to the planar surface so that the valve element restricts the flow of liquid through the opening a selected amount.

16. A sprinkler apparatus, comprising:

a housing having a hollow interior and an inlet port through which liquid can be supplied to the interior;

a stem within the interior of the housing and mounted for movement from a retracted position to an extended position, the stem having a passage that extends to a downwardly facing opening through which the flow of liquid can flow from the interior of the housing into the passage;

a valve element having a plurality of teeth;

means for mounting the valve element on the stem for movement of the valve element to vary an amount by which the valve element blocks the opening and for movement away from the stem;

a resiliently deformable splined shaft; and means for mounting the shaft for rotational movement with the splines engaging said teeth whereby rotation of the shaft moves the valve element to vary the amount by which the valve element blocks the opening and if movement of the valve element is impaired, the splines deform to urge the valve element away from the stem to allow rotation of the shaft with the splines skipping over said teeth.

17. A sprinkler apparatus, comprising:

a housing defining a hollow interior intermediate upper and lower ends of the housing and an inlet port through which to supply a flow of liquid to the interior;

a stem mounted within the interior of the housing to enable movement of the stem upwardly under influence of the flow of liquid from a retracted position to an extended position, the stem defining a passage that extends to a downwardly facing opening through which the flow of liquid can flow from the interior of the housing into the passage;

a generally planar surface circumscribing the downwardly facing opening;

a valve element dimensioned and arranged in confronting relationship with the planar surface to at least partially block the opening;

means for mounting the valve element on the stem to enable movement of the valve element in a plane generally parallel to the planar surface in order to vary an amount by which the valve element blocks the opening; and means for moving the valve element in the plane generally parallel to the planar surface so that the valve element restricts the flow of liquid through the opening a selected amount;

wherein the means for moving includes a shaft rotatably mounted on the housing and means for coupling rotational movement from the shaft to the valve element;

wherein the shaft has a plurality of splines and the valve element includes a first marginal edge portion that is pivotally mounted on the stem to enable pivotal movement about an axis generally perpendicular to the planar surface and a second marginal edge disposed toward the shaft, the second marginal edge having a plurality of teeth that are dimensioned and arranged to engage a plurality of splines on the shaft for purposes of coupling rotational movement from the shaft to the valve element to cause the valve element to pivot about the axis;

the apparatus further comprising means for urging the valve element slightly away from the planar surface when movement of the valve element is impaired; and wherein the means for urging includes the shaft being composed of a resiliently deformable material such that the shaft twists slightly when movement of the valve element is impaired so that at least one of the splines deforms slightly to bear generally downwardly against the valve element and thereby urge the valve element slightly away from the planar surface.

18. A sprinkler apparatus, comprising:

a housing defining a hollow interior intermediate upper and lower ends of the housing and an inlet port through which to supply a flow of liquid to the interior;

a stem mounted within the interior of the housing to enable movement of the stem upwardly under influence of the flow of liquid from a retracted position to an extended position, the stem defining a passage that extends to a downwardly facing opening through which the flow of liquid can flow from the interior of the housing into the passage;

a generally planar surface circumscribing the downwardly facing opening;

a valve element dimensioned and arranged in confronting relationship with the planar surface to at least partially block the opening;

means for mounting the valve element on the stem to enable movement of the valve element in a plane generally parallel to the planar surface in order to vary an amount by which the valve element blocks the opening; and means for moving the valve element in the plane generally parallel to the planar surface so that the valve element restricts the flow of liquid through the opening a selected amount;

wherein the valve element is composed of a resiliently deformable material such that the valve element can deform slightly to provide clearance between the valve element and the planar surface.

19. An improved sprinkler apparatus having:

a housing defining a hollow interior and an inlet port through which to supply a flow of liquid to the interior;

a stem mounted on the housing to be moved between a retracted position and an extended position, the stem having a passageway and an opening through which the flow of liquid can pass from the interior of the housing to the passageway within the stem;

a piston mounted within the housing to respond to the flow of liquid and move the stem from the retracted position to the extended position;

a valve element mounted on the stem, which valve element is adapted to be moved relative to the stem to at least partially block the opening;

a shaft rotatably mounted on the housing; and coupling means for coupling the shaft to the valve element so that the valve can be moved by rotation of the shaft for purposes of restricting the flow of liquid through the opening a selected amount;

wherein the improvement comprises:

the stem being configured so that the opening faces downwardly;

the stem having a generally planar surface circumscribing the opening;

the valve element being dimensioned and arranged in confronting relationship with the planar surface to at least partially block the opening; and the valve element being mounted on the stem to enable movement of the valve element in a plane generally parallel to the planar surface in order to vary an amount by which the valve element blocks the opening;

wherein the valve element is mounted on the stem to enable movement of the valve element about an axis that is generally perpendicular to the planar surface;

wherein the coupling means includes means for coupling rotational movement from the shaft to the valve element to cause the valve element to pivot about the axis;

wherein the shaft includes means for urging the valve element slightly away from the planar surface when movement of the valve element is impaired; and wherein the shaft has splines, the valve element has a series of teeth dimensioned and arranged to emerge the splines, and the shaft is composed of a resiliently deformable material such that the shaft twists slightly when movement of the valve element is impaired so that the at least one of the splines deforms slightly to bear downwardly against the valve element and thereby urge the valve element slightly away from the planar surface.

20. An apparatus as recited in claim 19, wherein:

the valve element is composed of a resiliently deformable material such that the valve element can deform slightly to provide clearance between the valve element and the planar surface.

21. A sprinkler apparatus, comprising:

a housing having a hollow interior, upper and lower ends and an inlet port through which to supply a flow of liquid to the interior;

a stem mounted within the interior of the housing to enable movement of the stem upwardly under influence of the flow of liquid from a retracted position to an extended position, the stem defining a passage that extends to a downwardly facing opening through which the flow of liquid can flow from the interior of the housing into the passage;

a surface circumscribing the downwardly facing opening;

a valve element dimensioned and arranged in confronting relationship with the surface to at least partially block the opening;

means for mounting the valve element on the stem to enable movement of the valve element to vary an amount by which the valve element blocks the opening;

means for moving the valve element so that the valve element restricts the flow of liquid through the opening a selected amount;

the means for moving including a shaft rotatably mounted on the housing and means for coupling rotational movement from the shaft to the valve element;

the shaft having a plurality of splines and the valve element including a first marginal edge portion that is pivotally mounted on the stem to enable pivotal movement about an axis generally perpendicular to the planar surface, and a second marginal edge disposed toward the shaft, the second marginal edge having a plurality of teeth that are dimensioned and arranged to engage a plurality of splines on the shaft for purposes of coupling rotational movement from the shaft to the valve element to cause the valve element to pivot about the axis;

means for urging the valve element slightly away from the surface when movement of the valve element is impaired; and the means for urging including the shaft being composed of a resiliently deformable material such that the shaft twists slightly when movement of the valve element is impaired so that at least one of the splines deforms slightly to bear generally downwardly against the valve element and thereby urge the valve element slightly away from the planar surface.

22. A sprinkler apparatus, comprising:

a housing having a hollow interior, upper and lower ends and an inlet port through which to supply a flow of liquid to the interior;

a stem mounted within the interior of the housing to enable movement of the stem upwardly under influence of the flow of liquid from a retracted position to an extended position, the stem defining a passage that extends to a downwardly facing opening through which the flow of liquid can flow from the interior of the housing into the passage;

a surface circumscribing the downwardly facing opening;

a valve element dimensioned and arranged in confronting relationship with the surface to at least partially block the opening;

means for mounting the valve element on the stem to enable movement of the valve element to vary an amount by which the valve element blocks the opening;

means for moving the valve element so that the valve element restricts the flow of liquid through the opening a selected amount; and the valve element being composed of a resiliently deformable material such that the valve element can deform slightly to provide clearance between the valve element and the surface.

* * * * *